US010542338B2

(12) United States Patent
Ely et al.

(10) Patent No.: US 10,542,338 B2
(45) Date of Patent: Jan. 21, 2020

(54) CONCEALED CONNECTOR FOR AN ELECTRONIC DEVICE

(71) Applicant: Apple Inc., Cupertino, CA (US)

(72) Inventors: Colin M. Ely, Sunnyvale, CA (US); Brad G. Boozer, Saratoga, CA (US); Benjamin J. Kallman, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/989,115

(22) Filed: May 24, 2018

(65) Prior Publication Data

US 2019/0098383 A1 Mar. 28, 2019

Related U.S. Application Data

(60) Provisional application No. 62/562,610, filed on Sep. 25, 2017.

(51) Int. Cl.
*H04R 1/02* (2006.01)
*H01R 13/631* (2006.01)

(52) U.S. Cl.
CPC ..... *H04R 1/02* (2013.01); *H01R 13/631* (2013.01); *H04R 2420/09* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,375,479 | B1 | 4/2002 | Johnson et al. | |
| 8,087,939 | B2 | 1/2012 | Rohrbach et al. | |
| 9,331,422 | B2 | 5/2016 | Nazzaro et al. | |
| 9,811,121 | B2 * | 11/2017 | Cardinali | G06F 1/1656 |
| 2012/0087521 | A1 * | 4/2012 | Delaus | B81C 1/00238 381/174 |
| 2014/0064542 | A1 * | 3/2014 | Bright | H04R 1/086 381/359 |

* cited by examiner

*Primary Examiner* — Sunita Joshi
(74) *Attorney, Agent, or Firm* — Kilpatrick Townsend and Stockton, LLP

(57) ABSTRACT

An electronic device includes a concealed electrical connector positioned within a speaker opening defined by an enclosure of the electronic device. A mating connector is configured to fit through the speaker opening and couple to the concealed electrical connector to form a bidirectional communications path with circuitry within the electronic device.

20 Claims, 6 Drawing Sheets

CONCEALED CONNECTOR FOR AN ELECTRONIC DEVICE

CROSS-REFERENCES TO OTHER APPLICATIONS

This application claims priority to U.S. provisional patent application Ser. No. 62/562,610, for "CONCEALED CONNECTOR FOR AN ELECTRONIC DEVICE" filed on Sep. 25, 2017 which is hereby incorporated by reference in entirety for all purposes.

FIELD

The described embodiments relate generally to electronic devices that employ acoustic electrical connectors for electronic devices. More particularly, the present embodiments relate to electronic connectors that can be concealed within an acoustic aperture or other port of an electronic device.

BACKGROUND

Currently there are a wide variety of electronic devices that have one or more external electronic connectors for communicating with internal circuitry within the electronic device. These external connectors can be used for charging the device and/or for performing uni-directional or bi-directional communications with the device. However, with small electronic devices it may be preferred to predominantly use wireless charging and/or wireless communications since the small electronic devices may not have room for external electrical connectors. Further, it may be desirable to not use external electrical connectors because they disrupt the exterior surface (e.g., the aesthetics) or they are difficult to seal for water resilient or waterproof electronic devices.

However, some electronic devices may still need an external electronic connector for performing settings at the factory and/or for performing repair and diagnostics on the device or for other uses.

New electronic devices may require new features or new methods of implementing external electronic connectors that are concealed, consume little space, provide uninterrupted device aesthetics, are water resilient and/or water proof.

SUMMARY

Some embodiments of the present invention relate to electronic devices having an electronic connector concealed within a speaker opening in the electronic device enclosure. A mating connector is configured to fit through the speaker opening and couple to the concealed electrical connector forming a bidirectional communications path with circuitry within the electronic device. The bidirectional communications path can be used to charge, program, diagnose and otherwise communicate with circuitry within the electronic device.

In some embodiments an electronic device comprises an enclosure defining a speaker aperture for emitting sound. A speaker is disposed within the enclosure and includes a diaphragm acoustically coupled to the speaker aperture. An acoustically permeable layer is positioned between the diaphragm and the speaker aperture, and a plurality of electrical contacts are disposed within the speaker aperture, positioned at an outer surface of the acoustically permeable layer and accessible through the speaker aperture.

In some embodiments the acoustically permeable layer includes a layer of acoustic mesh. In various embodiments the layer of acoustic mesh includes one or more electrically conductive fibers that are electrically coupled to at least one of the plurality of electrical contacts. In some embodiments the electronic device further comprises a backing plate disposed between the acoustically permeable layer and the diaphragm and is positioned to support the acoustically permeable layer.

In some embodiments the acoustically permeable layer includes a flexible circuit coupled to the plurality of electrical contacts. In various embodiments the acoustically permeable layer includes an insert-molded portion that is formed around the plurality of electrical contacts. In some embodiments the plurality of electrical contacts are electrically coupled to circuitry within the electronic device through a plurality of pins. In various embodiments a connector guide is formed around the plurality of electrical contacts to guide a mating connector into alignment with the plurality of electrical contacts. In some embodiments the speaker is disposed within a speaker housing and the speaker housing is sealed to the enclosure with one or more seals.

In some embodiments an electronic watch comprises an enclosure formed from a housing and a display screen that are joined together to define an exterior surface of the electronic watch. A speaker is disposed within the enclosure and includes a diaphragm. A speaker opening is defined by the enclosure and is formed at the exterior surface of the electronic watch. A processor is disposed within the enclosure and is coupled to the speaker with one or more conductors that carry signals causing the diaphragm to generate acoustic energy. An acoustic chamber is at least partially defined by the enclosure and couples the diaphragm to the speaker opening. An acoustically permeable layer is positioned between the diaphragm and the speaker opening and has an outer surface facing the speaker opening. A plurality of electrical contacts are disposed on the outer surface and accessible through the speaker opening.

In some embodiments the speaker opening is configured to receive a mating connector that extends from an exterior environment through the enclosure and electrically couples to the plurality of electrical contacts. In various embodiments the acoustically permeable layer includes a layer of acoustic mesh. In some embodiments the layer of acoustic mesh includes one or more electrically conductive fibers that are electrically coupled to at least one of the plurality of electrical contacts. In various embodiments the electronic watch further comprises a backing plate disposed between the acoustically permeable layer and the diaphragm and is positioned to support the acoustically permeable layer.

In some embodiments the acoustically permeable layer includes a flexible circuit coupled to the plurality of electrical contacts. In various embodiments the acoustically permeable layer includes an insert-molded portion that is formed around the plurality of electrical contacts. In some embodiments the plurality of electrical contacts are electrically coupled to circuitry within the electronic watch through a plurality of pins. In various embodiments a connector guide is formed around the plurality of electrical contacts to guide a mating connector into alignment with the plurality of electrical contacts.

In some embodiments the speaker is disposed within a speaker housing and the speaker housing is sealed to the enclosure with one or more seals. In various embodiments the acoustically permeable layer is integrally formed as a portion of a circuit board.

To better understand the nature and advantages of the present invention, reference should be made to the following description and the accompanying figures. It is to be understood, however, that each of the figures is provided for the purpose of illustration only and is not intended as a definition of the limits of the scope of the present invention. Also, as a general rule, and unless it is evident to the contrary from the description, where elements in different figures use identical reference numbers, the elements are generally either identical or at least similar in function or purpose.

DETAILED DESCRIPTION

Figure 1:
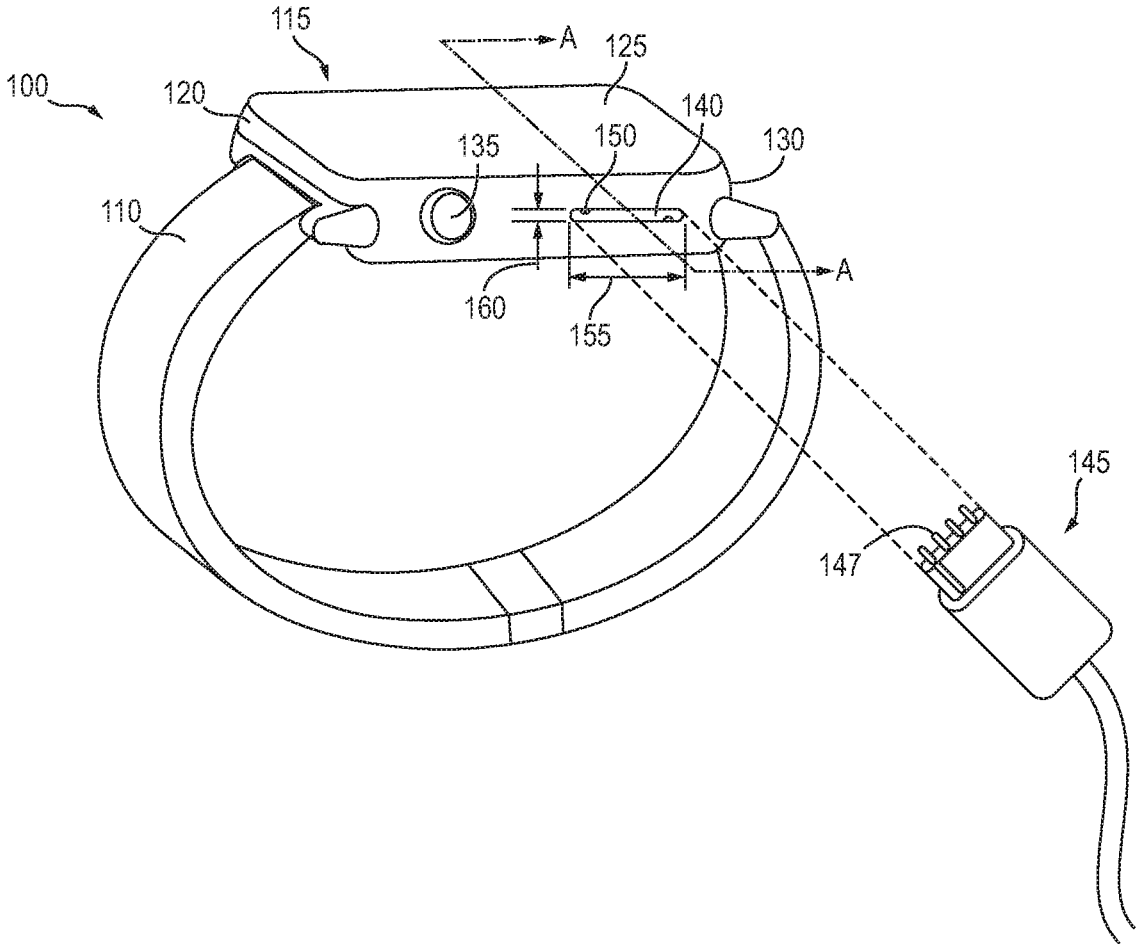
FIG. 1 is a perspective view of an electronic device according to embodiments of the disclosure.

Some embodiments of the present invention relate to electronic devices with a concealed electrical connector positioned within a speaker opening formed in an enclosure of the electronic device. A mating connector is configured to fit through the speaker opening and couple to the concealed electrical connector forming a bidirectional communications path with circuitry within the electronic device. The bidirectional communications path can be used to charge, program, diagnose and otherwise communicate with circuitry within the electronic device. By positioning the connector within the enclosure, the connector can be concealed from view, access to the connector can be restricted unless a specifically designed mating connector is used that can fit through the speaker opening and the electronic device is less susceptible to liquid ingression by reducing the number of openings formed in the enclosure since the speaker and the connector are combined within one opening.

While the present invention can be useful for a wide variety of configurations, some embodiments of the invention are particularly useful for electronic devices having small form factors with little space for electrical connectors, devices having aesthetic requirements that may be marred by an external visible electrical connector and/or or devices that need to be water resilient or waterproof, as discussed in more detail below.

For example, in some embodiments an electronic device can include a concealed electrical connector that enables a mating connector to establish one or more electronic communication channels with circuitry within the electronic device. The term concealed may be used to indicate that the connector is substantially imperceptible to the naked eye when viewing the outside of the electronic device. The concealed connector can be positioned within the enclosure of the electronic device and accessible through a speaker opening formed through the enclosure. The connector can include a plurality of contacts that are positioned at an outer surface of an acoustically permeable layer that is formed between a speaker positioned within the electronic device and the speaker opening formed in the enclosure. The plurality of contacts can be formed as a portion of a flexible circuit that couples the plurality of contacts to circuitry within the electronic device. A backing plate can be used to support the acoustic mesh and the plurality of contacts when a mating connector is inserted through the opening and pressed against the plurality of contacts.

In another example the plurality of contacts can be metallic studs that are insert-molded within a portion of the acoustically permeable layer and coupled to circuitry with a flexible circuit or with selective plating formed on a portion of the acoustically permeable layer. In another example a flexible circuit can be used to couple signals between the plurality of contacts and a feedthrough pin that couples signals from the flexible circuit through a waterproof speaker housing and to circuitry within the electronic device. In another example, a connector guide is formed around the plurality of contacts and includes features that guide the mating connector into alignment with the plurality of contacts.

In order to better appreciate the features and aspects of the present disclosure, further context for the disclosure is provided in the following section by discussing one particular implementation of an electronic device that includes a concealed connector according to embodiments of the disclosure. These embodiments are for explanatory purposes only and other embodiments may be employed in other electronic devices. For example, embodiments of the disclosure can be used with any device that receives or transmits audio, video or data signals. In some instances, embodiments of the disclosure are particularly well suited for use with portable electronic media devices because of their potentially small form factor. As used herein, an electronic media device includes any device with at least one electronic component that may be used to present human-perceivable media. Such devices may include, for example, wearable electronic devices (e.g., Apple's watch), portable music players (e.g., MP3 devices and Apple's iPod devices), portable video players (e.g., portable DVD players), cellular telephones (e.g., smart telephones such as Apple's iPhone devices), video cameras, digital still cameras, projection systems (e.g., holographic projection systems), gaming systems, PDAs, as well as tablet (e.g., Apple's iPad devices), laptop or other mobile computers. Some of these devices may be configured to provide audio, video or other data or sensory output.

FIG. 1 is an example electronic device 100 with a concealed connector (not shown in FIG. 1) that enables a user to establish a wired connection with circuitry within the electronic device. In this example electronic device 100 is a smart watch configured to be worn on a user's wrist and secured thereto with band 110. Electronic device 100 has an enclosure 115 defining an exterior surface 120. A screen 125 is attached to a housing 130, with the combination thereof forming enclosure 115. Screen 125 functions as an input/output device along with one or more buttons 135 that allow a user to communicate with electronic device 100.

A speaker opening 140 is formed through enclosure 115 and is coupled to a speaker (not shown in FIG. 1) positioned within the enclosure that is used to emit sound to the external environment for a user to hear. The concealed connector (not shown in FIG. 1) is positioned within enclosure 115 hidden from the user's view and is accessible through speaker opening 140. A specially designed mating connector 145 can be mated with the concealed connector by inserting the mating connector through speaker opening 140 such that pins 147 of the mating connector contact the concealed connector, as described in more detail below. In some embodiments one or more alignment features 150 formed on housing 130 can assist in alignment of mating connector 145 and/or key the mating connector so it can only be inserted with the proper orientation. In various embodiments an external alignment tool can be used in addition to or instead of alignment features 150 to align mating connector 145 with speaker opening 140 and concealed connector (not shown in FIG. 1).

In some embodiments speaker opening 140 can be a single opening as illustrated in FIG. 1, however in other embodiments it may include two, three or more openings. In some embodiments a length 155 of speaker opening 140 is between 2 and 40 millimeters while in other embodiments the length is between 5 and 30 millimeters and in other embodiments the length is between 10 and 20 millimeters. In some embodiments a width 160 of speaker opening 140 is between 0.25 and 4 millimeters and in other embodiments the width is between 0.5 and 2 millimeters and in various embodiments the width is between 0.75 and 1.25 millimeters. Although speaker opening 140 is illustrated in FIG. 1 as an elongated slot, other embodiments can have one or more speaker openings that are circular, square, hexagonal, rectangular or any other shape. Accordingly, the geometry of mating connector 145 can be modified to fit any shape of speaker opening.

Figure 2:
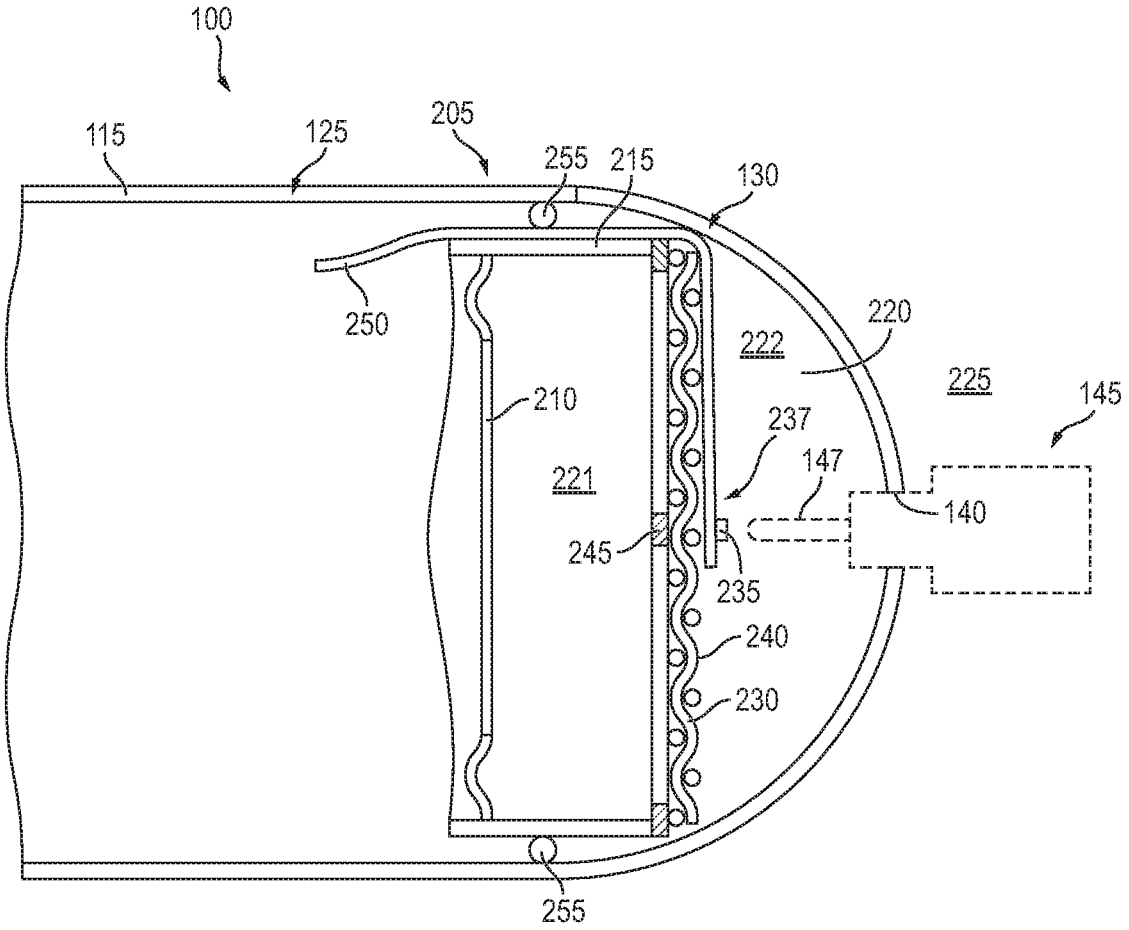
FIG. 2 is a simplified cross-sectional view of the electronic device shown in FIG. 1.

FIG. 2 illustrates a simplified cross-sectional view A-A formed through a portion of electronic device 100 illustrated in FIG. 1. As shown in FIG. 2, a speaker assembly 205 is positioned within enclosure 115 and includes a diaphragm 210 secured to a speaker housing 215 and one or more magnets (not shown in FIG. 2). An acoustic chamber 220 is formed within enclosure 115 and couples diaphragm 210 to speaker opening 140 such that sound can be emitted from the speaker opening to external environment 225.

An acoustically permeable layer 230 is disposed between diaphragm 210 and speaker opening 140. Acoustically permeable layer 230 allows acoustic energy that is generated by diaphragm 210 to pass through and exit speaker opening 140. Acoustically permeable layer 230 includes flexible circuit 250 and further includes a plurality of electrical contacts 235 attached to an outer surface 240 of the acoustically permeable layer. Outer surface 240 faces speaker opening 140. Plurality of electrical contacts 235 form a portion of concealed connector 237 and are positioned such that they are accessible by mating connector 145 that can be inserted through speaker opening 140. Acoustic chamber 220 includes a first portion 221 that is positioned between diaphragm 210 and acoustically permeable layer 230 and a second portion 222 that is positioned between acoustically permeable layer 230 and speaker opening 140.

In some embodiments a backing plate 245 is disposed between acoustically permeable layer 230 and diaphragm 210 and positioned against the acoustically permeable layer to support the acoustically permeable layer when mating connector 145 is pushed against and mated to concealed connector 237.

In the embodiment illustrated in FIG. 2 concealed connector 237 includes multiple contacts 235 (only one of which is visible in FIG. 2). In some embodiments plurality of contacts 235 are formed as a portion of a flexible circuit 250 as plated metal pads, however in other embodiments the plurality of pads are metallic pucks that are formed and attached to metal pads formed on the flexible circuit. Flexible circuit 250 is attached to acoustically permeable layer 230 using an adhesive or other material. In one embodiment, acoustically permeable layer 230 includes a layer of acoustic mesh that is laminated with flexible circuit 250 during the fabrication of the flexible circuit. In one example, the acoustic mesh is a woven layer of fabric (shown in FIG. 2 as having longitudinal and transverse fibers) while in another example it is a perforated plate of plastic or metal. Flexible circuit 250 includes conductive traces coupled to each electrical contact of plurality of contacts 235 and are used to route signals to circuitry disposed within electronic device 100. In some embodiments the conductive traces can be coupled to a processor that sends signals through the conductive traces to make diaphragm 210 move and generate acoustic energy.

In some embodiments, mating connector 145 includes multiple pins 147 that correspond in number to the number of contacts 235. Each individual pin can be spring-loaded and deflect when the mating connector is pushed into contact with contacts 235. Pins 147 can be used to accommodate variations in position of contacts 235 so a reliable connection is made.

One or more seals 255 can be positioned between speaker housing 215 and enclosure 115 to seal acoustic chamber 220 such that liquid, dust or other contaminants cannot pass beyond the speaker housing and damage circuitry within electronic device 100. In some embodiments plurality of contacts 235 can be electrically decoupled from the internal circuitry via electrical means or mechanical means such that liquid that enters acoustic chamber 220 cannot short out concealed connector 237. To couple the plurality of contacts 235 to the internal circuitry pressure may need to be exerted on mating connector 145 such that backing plate 245 deforms and the circuit is temporarily completed or electrical switches can be used to decouple contact pads from the circuitry within electronic device 100. In further embodiments a non-electrically conductive self-healing elastomeric coating can be applied over plurality of contacts 235 that can be displaced and/or temporarily penetrated by pins 147 of mating connector 145.

Flexible circuit 250, as disclosed herein, describes a circuit that includes an insulating polymer film having conductive circuit patterns affixed thereto and can also include a polymer coating to protect the conductor circuits. Flexible circuits can include a single metal layer, double sided metal layers, multilayer and rigid/flex combination constructions. Flexible circuits can be formed by etching metal foil cladding (normally of copper) from polymer bases, plating metal or printing of conductive inks, among other processes. Flexible circuits can also include one or more electronic passive or active components attached thereto. Flexible circuits can be fabricated using a lamination process that adheres layers together with an adhesive or polymer under pressure, elevated temperature and/or vacuum.

Backing plate 245 as described herein can be fabricated as a portion of enclosure 115, as a portion of speaker housing 215, as a portion of acoustically permeable layer 230 or as a separate component. Backing plate 245 can be fabricated from metal (including powdered metal known as MIM), plastic, ceramic or any other material and has one or more openings to allow sound to pass through, as described in more detail below.

Figure 3:
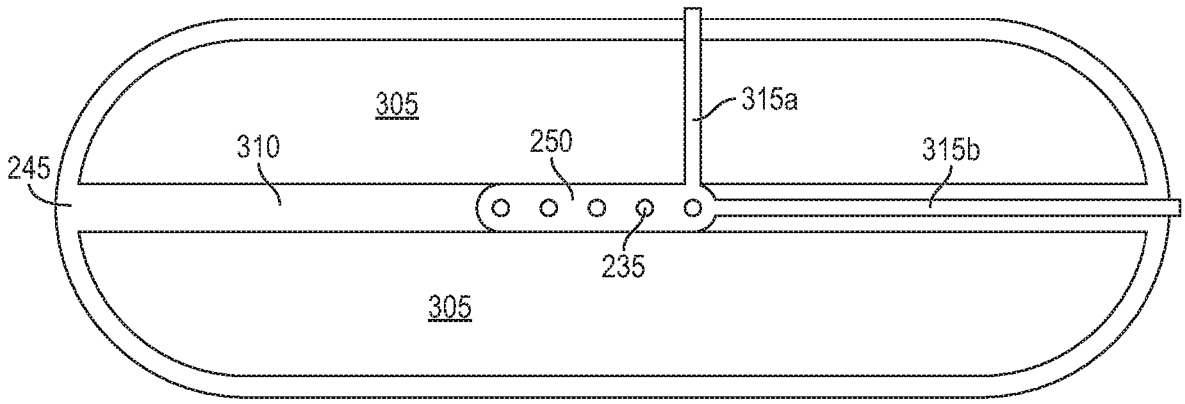
FIG. 3 is plan view looking into the speaker opening of the electronic device shown in FIG. 1.

FIG. 3 illustrates a plan view looking into speaker opening 140, with acoustically permeable layer 230 removed for clarity. As shown in FIG. 3 backing plate 245 includes one or more openings 305 that allow sound to pass from diaphragm 210 (see FIG. 2) through acoustically permeable layer 230 and out of speaker opening 140. Backing plate 245 also includes a structural member 310 positioned directly behind contacts 235, which in the embodiment depicted in FIG. 3 includes four contacts, to provide support during engagement of mating connector 145 (see FIG. 2).

As discussed above, contacts 235 can be formed on flexible circuitry 250 and the flexible circuit can include electrical traces that couple signals between circuitry within the electronic device 100 and contacts 235. Flexible circuit 250 can include one or more routing portions 315*a*, 315*b* that route signals from plurality of contacts 235 to circuitry within electronic device 100. In some embodiments each individual contact 235 can have a diameter between 0.1 to 4.0 millimeters and in other embodiments between 0.3 to 2.0 millimeters and in various embodiments between 0.7 to 1.3 millimeters.

In some embodiments a concealed electrical connector as described herein can be positioned in an opening within an electronic device wherein the opening is not a speaker opening but is used for a different purpose. For example, in some embodiments speaker opening 140 (see FIGS. 1 and 2) can be used for a different purpose including but not limited to a microphone, an air vent, a sensor (e.g., barometric, temperature, humidity, etc.) or it may only be used to house the concealed connector. As an illustrative example, the configuration illustrated in FIG. 3 can be used to show such embodiments. For example, one or more openings 305 can be used as air vents for electronic device 100, and structural member 310 can be used as shown to hold contacts 235 in place so they can be coupled with a mating connector as shown in FIG. 1. In other embodiments one or more openings 305 can be used as apertures for a microphone and/or a sensor that are disposed within electronic device 100, enabling them to communicate with the external environment. In another embodiment speaker opening 140 may have no other function than to house the hidden connector that includes contacts 235.

Figure 4:
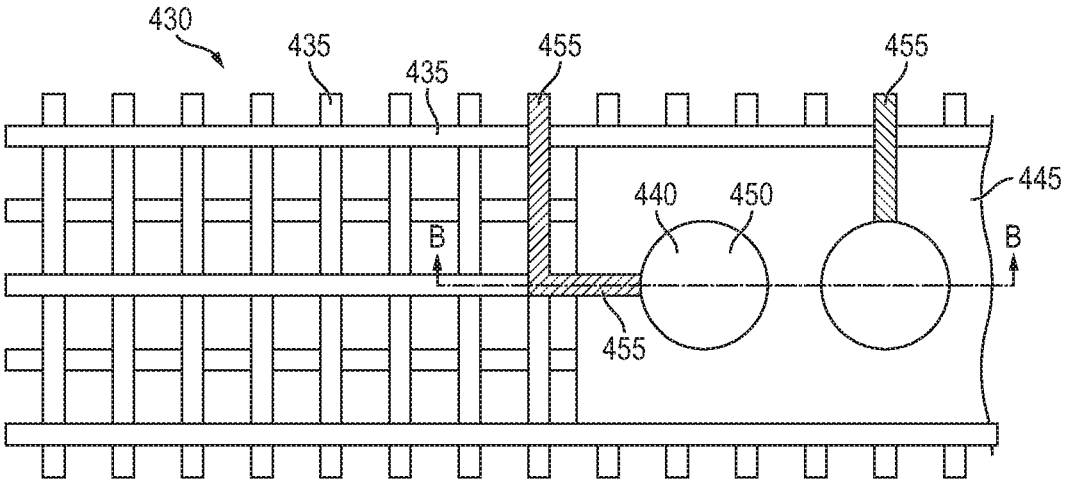
FIG. 4 is a magnified view of a plan view looking into the speaker opening of the electronic device shown in FIG. 1.

FIG. 4 illustrates a magnified portion of a plan view looking into speaker opening 140 (see FIG. 1) of another embodiment that uses insert-molded studs 440 to form a plurality of contacts 450 and selectively conductive acoustic mesh in place of the flexible circuit discussed above in FIGS. 2 and 3. As shown in FIG. 4, acoustically permeable layer 430 is formed from a woven acoustic mesh including individual woven fibers 435. A plurality of studs 440 that are made from an electrically conductive material such as metal, are insert-molded within a connector plate 445 that can also be formed around a portion of acoustically permeable layer 430. Signals are coupled from plurality of contacts 450 to circuitry within electronic device 100 using one or more traces 455 formed by selectively metallizing portions of acoustically permeable layer 430, as discussed in more detail below.

The size of connector plate 445 can be small relative to speaker opening 140 (see FIG. 1) such that a majority of acoustically permeable layer 430 is available to pass acoustic energy from speaker assembly 205 (see FIG. 2) to speaker opening 140. In some embodiments connector plate 445 can be formed separately from or integrally with backing plate 245 (see FIG. 3). More specifically, in some embodiments connector plate 445 and backing plate 245 can be simultaneously formed with an insert molding process, however in other embodiments they may be formed separately.

Figure 5:
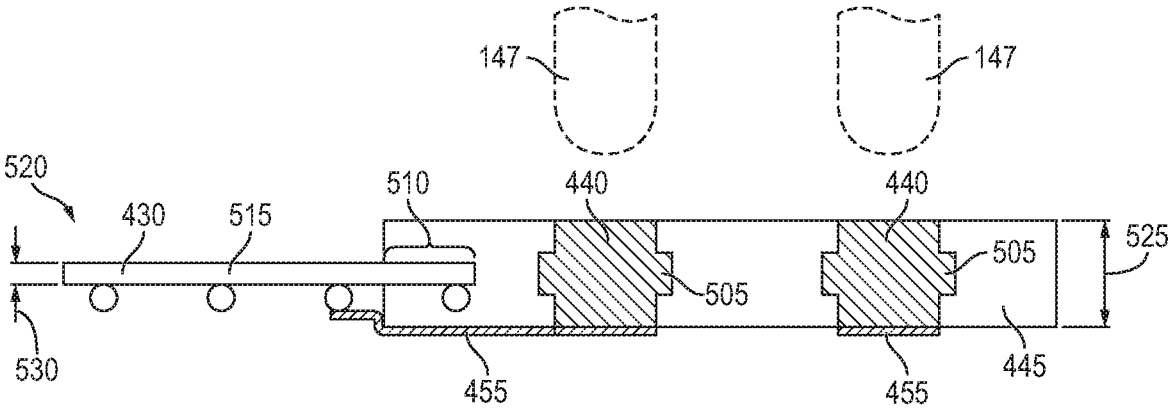
FIG. 5 is a partial cross-sectional view of the connector plate illustrated in FIG. 4.

FIG. 5 illustrates a simplified partial cross-sectional view B-B formed through a portion of connector plate 445 and acoustically permeable layer 430 illustrated in FIG. 4. As shown in FIG. 5, studs 440 can include mold-lock features 505 that secure the studs within connector plate 445. Acoustically permeable layer 430 includes a mold portion 510 that can be insert-molded within connector plate 445.

One or more traces 455 can be formed from each of studs 440 and routed along connector plate 445, across acoustically permeable layer 430 and coupled with circuitry within electronic device 100 (see FIG. 2). More specifically, in some embodiments one or more traces 455 can be formed with a selective metallization process such as, but not limited to, laser-direct structuring (LDS), physical vapor deposition, selective photolithography, ion-beam deposition, or other process. As shown in FIG. 5, in some embodiments a metallized trace can be formed along one or more fibers 515 of an acoustic mesh 520. In other embodiments, one or more fibers 515 of acoustic mesh 520 can be formed from an electrically conductive metal, or at least partially from a metal and used as a conductor to route the one or more signals.

In some embodiments connector plate 445 has a thickness 525 that is between 0.1 and 0.5 millimeters while in other embodiments the thickness is between 0.2 and 0.4 millimeters and in various embodiments the thickness is between 0.25 and 0.35 millimeters.

In some embodiments acoustically permeable layer 430 has a thickness 530 that is between 0.025 and 0.2 millimeters while in other embodiments the thickness is between 0.5 and 0.15 millimeters and in various embodiments the thickness is between 0.075 and 0.125 millimeters.

Figure 6:
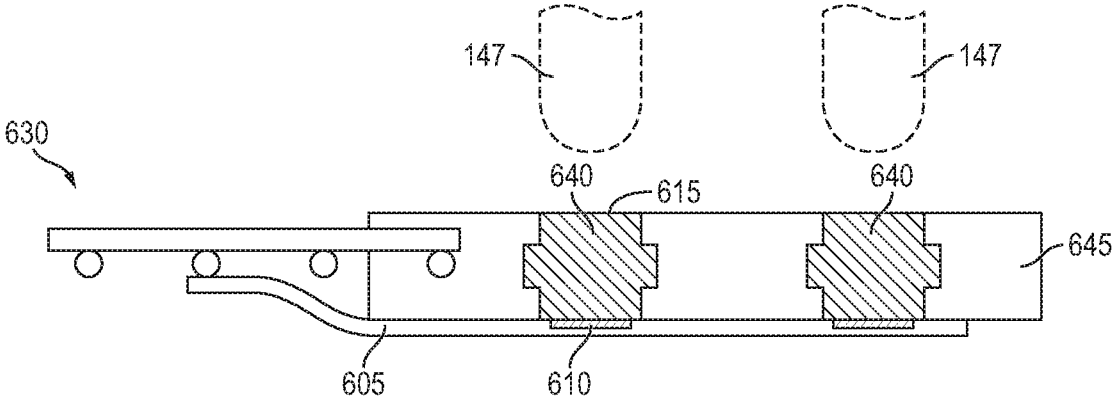
FIG. 6 is a partial cross-sectional view of an alternative embodiment of a connector plate according to embodiments of the disclosure.

FIG. 6 illustrates an alternative embodiment of a partial cross-sectional view B-B formed through a portion of a connector plate 645 and an acoustically permeable layer 630 illustrated in FIG. 4. Compared to the embodiment illustrated in FIG. 5, in FIG. 6 a flexible circuit 605 is used to electrically couple studs 640 to circuitry within the electronic device. More specifically, flexible circuit 605 includes one or more pads 610 that are attached to studs 640 with solder or other conductive means such as electrically conductive epoxy. Flexible circuit 605 then routes signals from contacts 615 to circuitry within the electronic device.

Figure 7:
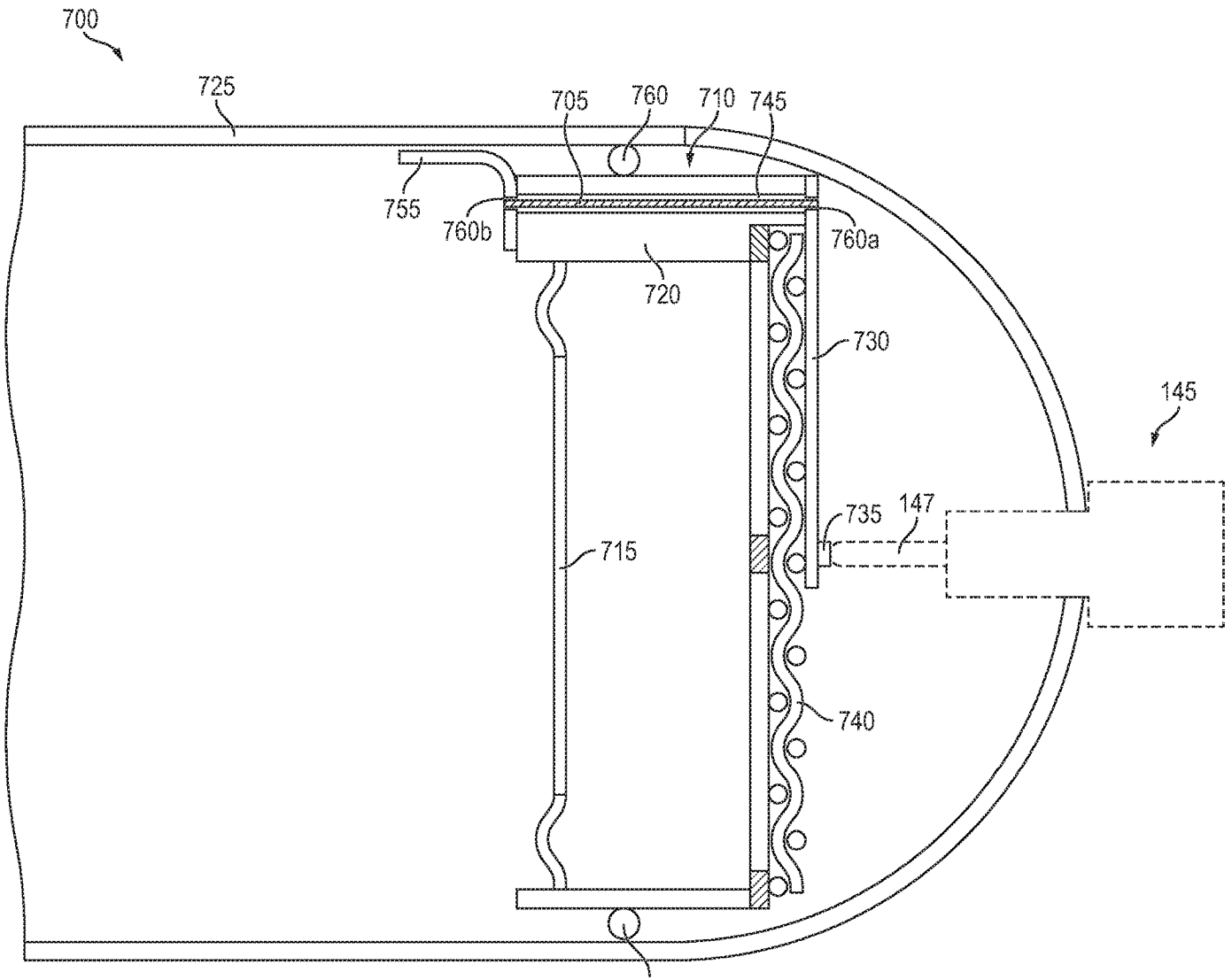
FIG. 7 is a simplified cross-sectional view of an alternative electronic device including electrically conductive pins according to embodiments of the disclosure.

FIG. 7 illustrates an alternative internal construction of an embodiment of an electronic device as compared to the electronic device illustrated in FIG. 2. FIG. 7 illustrates a simplified cross-sectional view similar to the view shown in FIG. 2, however in FIG. 7 electronic device 700 employs a conductive metal pin 705 to route signals past speaker assembly 710, as compared to the embodiment illustrated in FIG. 2 that used a flexible circuit board. As shown in FIG. 7, speaker assembly 710 includes a diaphragm 715 disposed within a speaker housing 720 that is positioned within enclosure 725. Similar to the embodiment illustrated in FIG. 2, a flexible circuit board 730 is used to form plurality of contacts 735 and route signals across acoustically permeable layer 740. However, in this embodiment a portion of speaker housing 720 includes one or more channels 745 that accommodate one or more conductive metal pins 705 that couple signals from flexible circuit board 730 to routing structure 755 positioned behind seal 760 and used to route signals to circuitry within electronic device 700. In some embodiments one or more conductive metal pins 705 are attached to flexible circuit board 730 and routing structure 755 by soldering the pin into vias 760*a*, 760*b*, however other embodiments can use a different method of connection. In various embodiments one or more metal pins 705 can be insert-molded or stitched within housing 720 forming a liquid-tight interface to the housing.

In some embodiments, instead of one or more metal pins 705, an alternative electrical interconnect can be used and can include an anisotropic conductive elastomer (ACE) including electrically conductive regions separated by electrically insulating regions within an elastomeric panel, a plurality of aligned conductive wires inserted within an elastomeric panel, pogo pins, a wire or any other type of electrical interconnect.

Figure 8:
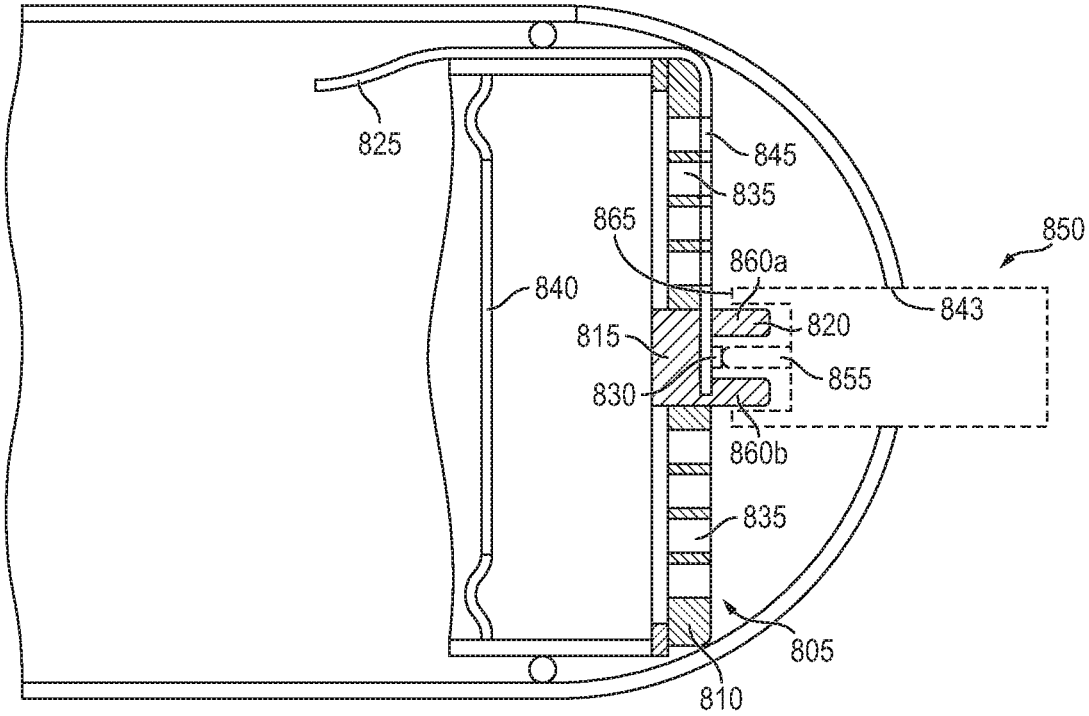
FIG. 8 is a simplified cross-sectional view of an alternative electronic device including a connector alignment feature according to embodiments of the disclosure.

FIG. 8 illustrates a simplified cross-sectional view A-A formed through a portion of an electronic device 800 that is similar to electronic device 100 illustrated in FIG. 1. However, FIG. 8 shows an alternative internal construction of electronic device 800 as compared to the embodiments shown in FIGS. 2 and 7, and employs an acoustically permeable layer 805 comprising a perforated plate 810 and a connector plate 815 that includes a mating connector guide 820. As shown in FIG. 8, a flexible circuit board 825 is used to couple plurality of contacts 830 to circuitry within electronic device 800. However, in this embodiment acoustically permeable layer 805 includes connector plate 810 with a plurality of perforations 835 that allow acoustic energy from diaphragm 840 to pass through the acoustically permeable layer and exit speaker opening 843. In this embodiment, flexible circuit board 825 includes a plurality of openings 845 that align with plurality of perforations 835 to allow sound to pass through the flexible circuit board. In this way, flexible circuit board 825 can cover a significant portion of acoustically permeable layer 805 and not restrict the acoustic performance of electronic device 800.

As further illustrated in FIG. 8, connector plate 810 includes mating connector guide 820 that is formed to interface with mating connector 850 such that a plurality of pins 855 on the mating connector are aligned with plurality of contacts 830. In this embodiment guide 820 can include raised portions 860*a*, 860*b* that can be rounded and/or tapered to align bulkhead 865 of mating connector 850 before plurality of pins 855 come into contact with plurality of contacts 830. Other alignment features can be used and are within the scope of this disclosure. Because the relatively small dimensions of the concealed connector, alignment features such as guide 820 and one or more alignment features 150 (see FIG. 1) can be useful to assist in the proper and reliable mating of mating connector 850 with electronic device 800.

For simplicity, various internal components, such as the circuitry, processor, graphics circuitry, bus, memory, storage device and other components of electronic devices 100, 700 and 800 (see FIGS. 1, 7 and 8, respectively) are not shown in the figures. The embodiments described above have been illustrated in a smart watch, however similar concealed connectors can be implemented in any electronic device. Further, the embodiments above have illustrated a hidden connector disposed within a speaker aperture of the electronic device, however a hidden connector can be disposed in any aperture including, but not limited to, a barometric vent, a sensor aperture, or a non-functional aperture that is only used to conceal the connector.

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction. The specific details of particular embodiments may be combined in any suitable manner without departing from the spirit and scope of embodiments of the invention.

Additionally, spatially relative terms, such as "bottom" or "top" and the like may be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as a "bottom" surface may then be oriented "above" other elements or features. The device may be otherwise oriented (e.g., rotated 90 degrees or at other orientations) and the spatially relative descriptors used herein interpreted accordingly.

What is claimed is:

1. An electronic device comprising:

an enclosure defining a speaker aperture for emitting sound;

a speaker disposed within the enclosure and including a diaphragm acoustically coupled to the speaker aperture;

an acoustically permeable layer positioned between the diaphragm and the speaker aperture, wherein the acoustically permeable layer includes an inner surface adjacent the diaphragm and an outer surface adjacent the speaker aperture; and a plurality of electrical contacts disposed within the speaker aperture and positioned at the outer surface of the acoustically permeable layer such that the electrical contacts are accessible by a mating connector inserted through the speaker aperture.

2. The electronic device of claim 1 wherein the acoustically permeable layer includes a layer of acoustic mesh.

3. The electronic device of claim 2 wherein the layer of acoustic mesh includes one or more electrically conductive fibers that are electrically coupled to at least one of the plurality of electrical contacts.

4. The electronic device of claim 1 further comprising a backing plate disposed between the acoustically permeable layer and the diaphragm and positioned to support the acoustically permeable layer.

5. The electronic device of claim 1 wherein the acoustically permeable layer includes a flexible circuit coupled to the plurality of electrical contacts.

6. The electronic device of claim 1 wherein the acoustically permeable layer includes an insert-molded portion that is formed around the plurality of electrical contacts.

7. The electronic device of claim 1 wherein the plurality of electrical contacts are electrically coupled to circuitry within the electronic device through a plurality of pins.

8. The electronic device of claim 1 wherein a connector guide is formed around the plurality of electrical contacts to guide the mating connector into alignment with the plurality of electrical contacts.

9. The electronic device of claim 1 wherein the speaker is disposed within a speaker housing and the speaker housing is sealed to the enclosure with one or more seals.

10. An electronic watch comprising:

an enclosure formed from a housing and a display screen that are joined together to define an exterior surface of the electronic watch;

a speaker disposed within the enclosure and including a diaphragm;

a speaker opening defined by the enclosure and formed at the exterior surface of the electronic watch;

a processor disposed within the enclosure and coupled to the speaker with one or more conductors that carry signals causing the diaphragm to generate acoustic energy;

an acoustic chamber at least partially defined by the enclosure and coupling the diaphragm to the speaker opening;

an acoustically permeable layer positioned between the diaphragm and the speaker opening and having an outer surface facing the speaker opening; and a plurality of electrical contacts disposed on the outer surface and accessible by a mating connector inserted through the speaker opening.

11. The electronic watch of claim 10 wherein the speaker opening is configured to receive the mating connector that extends from an exterior environment through the enclosure and electrically couples to the plurality of electrical contacts.

12. The electronic watch of claim 10 wherein the acoustically permeable layer includes a layer of acoustic mesh.

13. The electronic watch of claim 12 wherein the layer of acoustic mesh includes one or more electrically conductive fibers that are electrically coupled to at least one of the plurality of electrical contacts.

14. The electronic watch of claim 10 further comprising a backing plate disposed between the acoustically permeable layer and the diaphragm and positioned to support the acoustically permeable layer.

15. The electronic watch of claim 10 wherein the acoustically permeable layer includes a flexible circuit coupled to the plurality of electrical contacts.

16. The electronic watch of claim 10 wherein the acoustically permeable layer includes an insert-molded portion that is formed around the plurality of electrical contacts.

17. The electronic watch of claim 10 wherein the plurality of electrical contacts are electrically coupled to circuitry within the electronic watch through a plurality of pins.

18. The electronic watch of claim 10 wherein a connector guide is formed around the plurality of electrical contacts to guide the mating connector into alignment with the plurality of electrical contacts.

19. The electronic watch of claim 10 wherein the speaker is disposed within a speaker housing and the speaker housing is sealed to the enclosure with one or more seals.

20. The electronic watch of claim 10 wherein the acoustically permeable layer is integrally formed as a portion of a circuit board.

* * * * *